US009824565B1

(12) United States Patent
Patel

(10) Patent No.: US 9,824,565 B1
(45) Date of Patent: Nov. 21, 2017

(54) SMOKE DETECTOR SYSTEM WITH EXPANDED CAPABILITIES

(71) Applicant: Ricky Patel, Coral Gables, FL (US)

(72) Inventor: Ricky Patel, Coral Gables, FL (US)

( * ) Notice: Subject to any disclaimer, the term of this patent is extended or adjusted under 35 U.S.C. 154(b) by 0 days.

(21) Appl. No.: 14/853,220

(22) Filed: Sep. 14, 2015

Related U.S. Application Data

(60) Provisional application No. 62/049,777, filed on Sep. 12, 2014.

(51) Int. Cl.
*G08B 13/00* (2006.01)
*G08B 17/12* (2006.01)

(52) U.S. Cl.
CPC ..... *G08B 17/125* (2013.01)

(58) Field of Classification Search
CPC ..... G08B 17/125; G08B 13/00; G08B 13/19632; G08B 13/19697; G08B 15/02; G08B 25/00
USPC ..... 340/539.25, 539.27, 540, 541, 522, 550, 340/628, 632
See application file for complete search history.

(56) References Cited

U.S. PATENT DOCUMENTS

2005/0271250 A1* 12/2005 Vallone ..... G06K 9/00288 382/103
2007/0252720 A1* 11/2007 Hughes ..... G08B 15/002 340/691.3
2009/0121861 A1* 5/2009 Latham ..... G08B 13/19632 340/522
2014/0307096 A1* 10/2014 Park ..... G08B 13/1672 348/152

* cited by examiner

*Primary Examiner* — Hung T Nguyen
(74) *Attorney, Agent, or Firm* — Allen Dyer Doppelt & Gilchrist, PA

(57) ABSTRACT

A smoke detector system functionally integrates several systems into a common housing, including smoke/carbon monoxide detection, motion sensing, camera, lighting and audio systems.

5 Claims, 8 Drawing Sheets

SMOKE DETECTOR SYSTEM WITH EXPANDED CAPABILITIES

CROSS-REFERENCE TO RELATED APPLICATION

This application claims the benefit of U.S. Provisional Patent Application Ser. No. 62/049,777, filed on Sep. 12, 2014, the contents of which are herein incorporated by reference in their entirety.

FIELD OF THE INVENTION

The present invention relates generally to a smoke detector system comprising devices further comprising smoke detectors, carbon monoxide detectors, motion detectors, wireless connections, powerline connections, speakers, cameras, batteries, and mobile monitors, wherein the system is used to implement, monitor, and control safety, security, lighting, wireless repeater, doorbell, and audio systems.

BACKGROUND OF THE INVENTION

Nowadays, many home systems for safety, comfort, and entertainment are becoming smarter and more powerful. Separate systems exist which utilize network connections to enable users to monitor their living spaces for dangers such as fires, carbon monoxide, or security breaches, control the lighting and music that they play in their homes, and reliably connect to wireless communications anywhere in their house. But there are few systems which bring all of these systems together in one comprehensive package, easily installed and set up, with all systems controllable through one user interface on a mobile monitoring device, and with the systems integrated with each other. A unification of safety systems, network connections, environmental controls, and entertainment systems is attractive for implementation in homes, college dorms, and office spaces. It is the objective of the present invention to bring together fire and carbon monoxide monitoring, security, network, lighting, doorbell, and audio systems in one attractive and easily managed housing, with connection to mobile monitors to allow users to easily and conveniently control and communicate with the various systems of the invention.

DETAILED DESCRIPTION OF THE INVENTION

Figure 1:
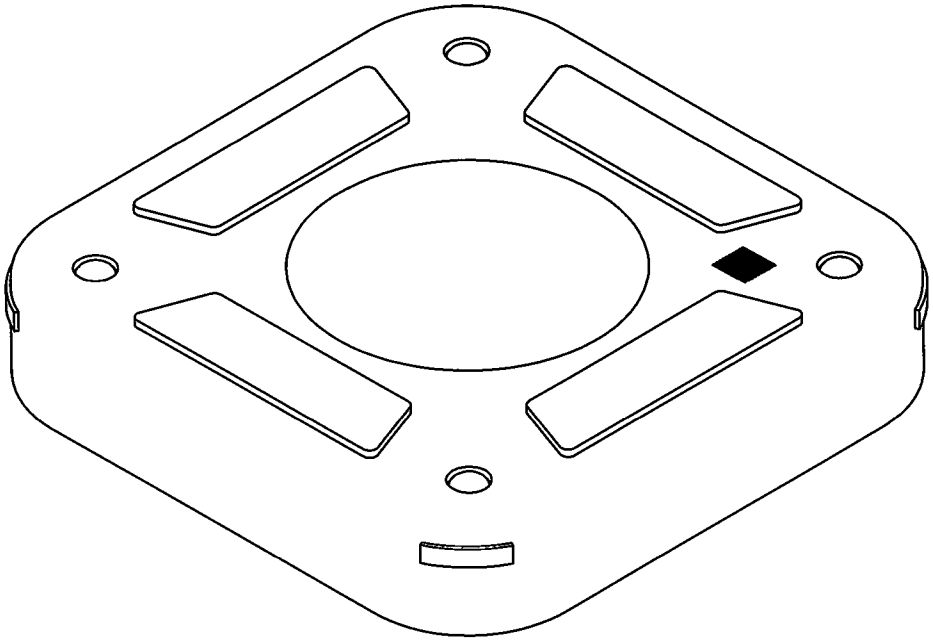
FIG. 1 is a perspective view of one possible embodiment of a device of a smoke detector system with expanded capabilities.
Figure 2:
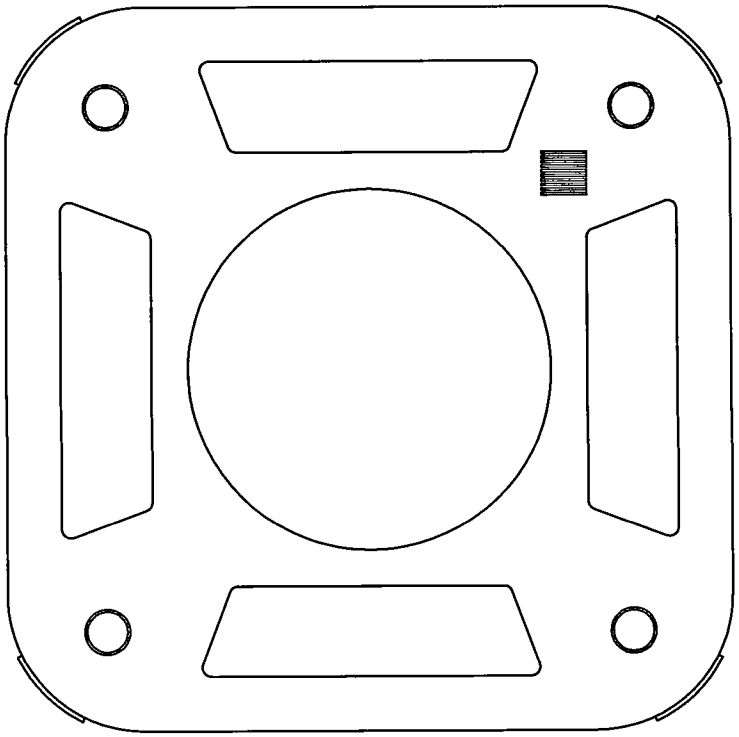
FIG. 2 is a plain bottom view of one possible embodiment of a device of a smoke detector system with expanded capabilities.
Figure 3:
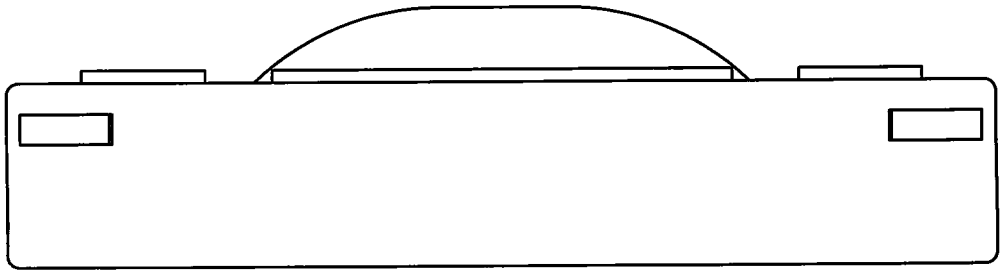
FIG. 3 is a plain side view of one possible embodiment of a device of a smoke detector system with expanded capabilities.
Figure 4:
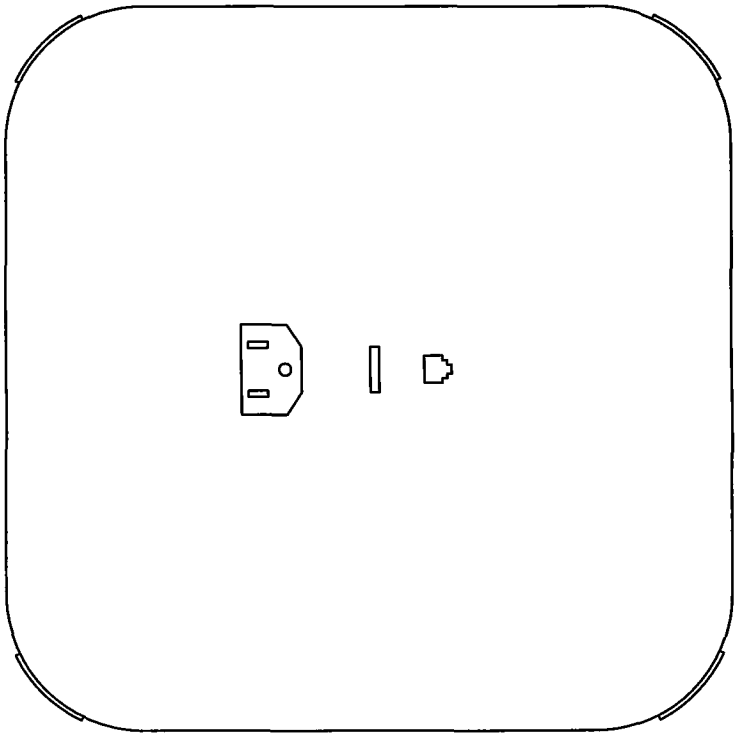
FIG. 4 is a plain side top view of one possible embodiment of a device of a smoke detector system with expanded capabilities showing some of the possible connection options.
Figure 5:
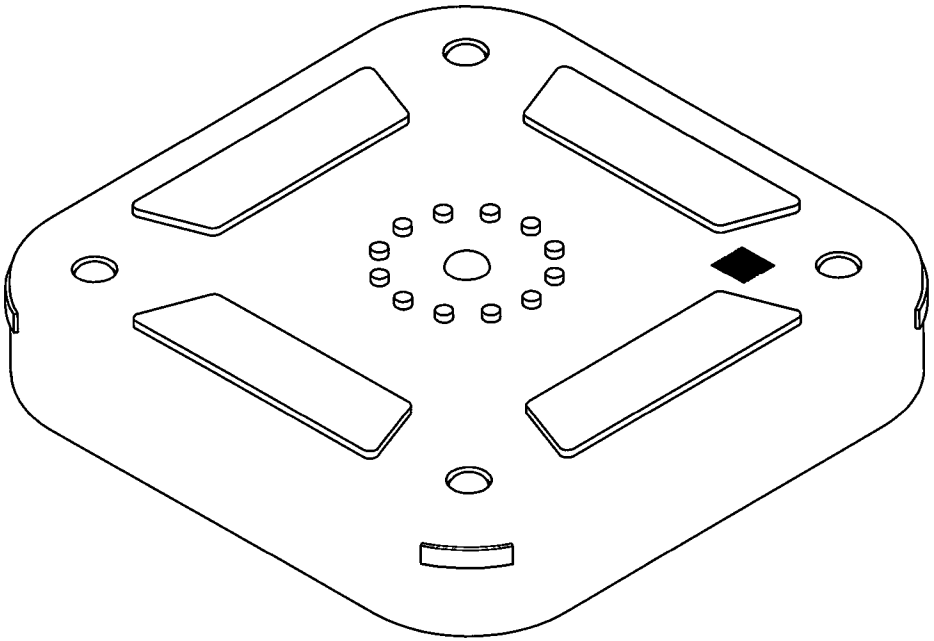
FIG. 5 is a perspective view of one possible embodiment of a device of a smoke detector system with expanded capabilities with the curved translucent cover removed, revealing the plurality of light emitting diodes and an additional motion detector.
Figure 6:
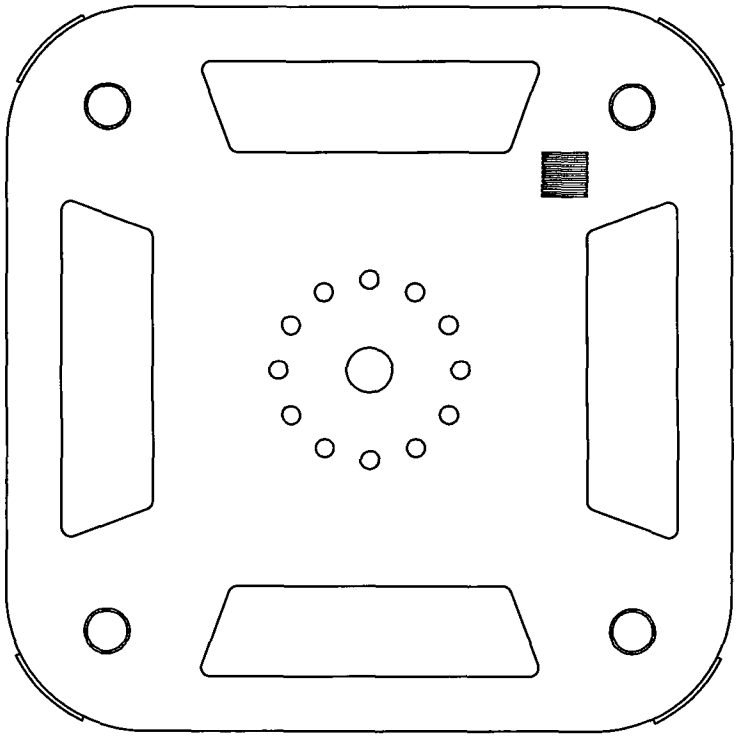
FIG. 6 is a plain bottom view of one possible embodiment of a device of a smoke detector system with expanded capabilities with the curved translucent cover removed.
Figure 7:
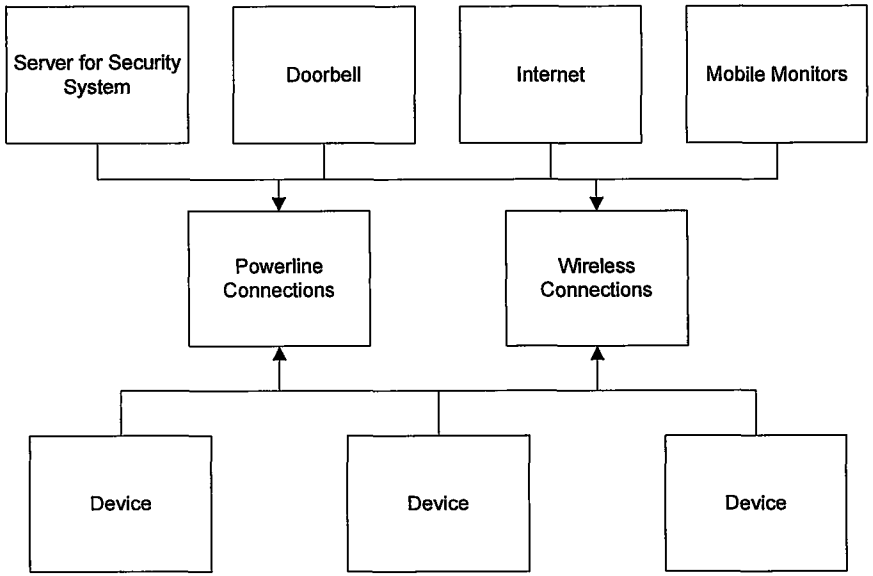
FIG. 7 is a flowchart demonstrating the various connections between the plurality of devices and external components through the plurality of powerline communication connections and plurality of wireless connections.
Figure 8:
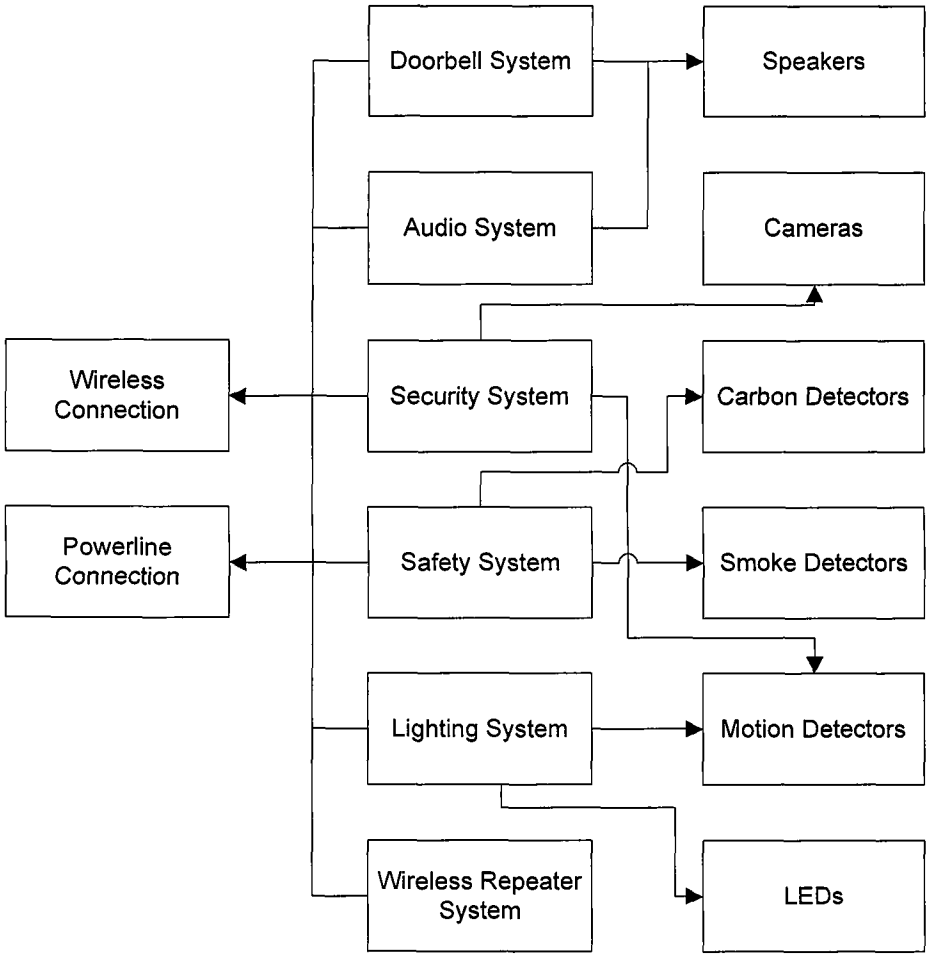
FIG. 8 is a flowchart demonstrating the use of various subcomponents of the plurality of devices within the various subsystems of the smoke detector system with expanded capabilities.

All illustrations of the drawings are for the purpose of describing selected versions of the present invention and are not intended to limit the scope of the present invention.

A smoke detector with expanded capabilities further comprises a plurality of devices, a plurality of mobile monitors, a safety system, a security system, a wireless repeater system, a lighting system, a doorbell system, and an audio system.

The plurality of devices is arranged throughout a house or dorm room and work together to facilitate the functioning of the various systems. Each of the plurality of devices further comprise a smoke detector, a carbon monoxide detector, a plurality of wireless connections, a plurality of powerline communication connections, a plurality of proximity sensors, a plurality of cameras, a plurality of speakers, a plurality of light emitting diodes, a battery, a power cable, and a USB connection.

The smoke detector senses the presence of smoke or fire and may comprise a light emitting diode as a light source and a photodiode as a photoelectric receiver. The carbon monoxide detector senses the presence of carbon monoxide and may use biometric, electrochemical, or semiconductor sensors. The plurality of motion detectors may be located on each of four corners of each device, and may comprise capacitive, photoelectric, or inductive proximity sensors, or motion sensors utilizing passive infrared, microwave, ultrasonic, or tomographic means.

The plurality of wireless connections enables the devices to communicate with each other and with the plurality of mobile monitors, as well as to receive signals from sources outside the system, and to facilitate the wireless repeater system. The plurality of wireless connections may include but it not limited to a wireless network repeater of the type 802.11a/b/g/n/ac, Bluetooth, 915 MHz or 131.65 KHz Insteon, and 908.42 MHz Z-Wave. The plurality of powerline communication connections enables the transmission of data on a conductor used simultaneously for electric power transmission. The plurality of powerline communication connections may include but is not limited to IEEE 1901, Qualcomm Hy-Fi, X10, and Insteon Powerline 131.65 KHz.

The plurality of cameras take picture and video of the area around the device and may be mounted near four corners of each of the device. The plurality of speakers amplifies and outputs high and low frequencies of sound and may comprise stereo pairs of acoustic drivers, and dual passive bass radiators. The plurality of light emitting diodes provides light to the room in which the device is located, and is located under a curved translucent cover. The light emitting diodes and translucent cover may be any color or opacity. The primary power source for the device is a 120V connection to an alternate current main. The battery acts as a rechargeable and replaceable backup power source for the device and may comprise a lithium ion battery.

The USB connection is used in setting up, testing, and programming, wherein any of the plurality of devices is programmed by an external computing means and acts as a primary device, transferring the setup information to all other devices. The plurality of mobile monitors enable a user to monitor and control the smoke detector system with expanded capabilities, and comprises a user interface implemented on a mobile communications device which may be a cellular phone, smart phone, tablet, laptop computer, or similar, the mobile communications device further comprising a video display, microphone, and mobile wireless connection. The plurality of devices is aware which of the plurality of mobile monitors are on the network, and use LAN to communicate rather than WAN.

The smoke detector system with expanded capabilities uses the plurality of devices and plurality of mobile monitors to implement the safety system, security system, wireless repeater system, lighting system, doorbell system, and audio system.

The safety system utilizes the smoke detectors and carbon monoxide detectors to identify threats, and sends notifications to the plurality of mobile monitors via the plurality of wireless connections, as well as sounding alarms through the plurality of speakers. The security system uses the plurality of motion detectors to identify a breach, and activates the plurality of cameras, sends notifications to the plurality of mobile monitors via the plurality of wireless connection, and sounds alarms through the plurality of speakers.

The plurality of cameras are constantly recording, and are linked to an external server which will save camera data when activated by signals from the plurality of motion detectors for a specified amount of time before and after motion is detected. The wireless repeater system will utilize the plurality of wireless connections and powerline connections as well as any amplifiers or other necessary components to extend the range of an existing wireless network. The lighting system utilizes the plurality of motion detectors as well as wireless communication with the plurality of mobile monitoring devices to determine the presence of a person, and actuates the plurality of light emitting diodes beneath the curved translucent cover. The plurality of motion detectors will actuate the plurality of light emitting diodes based on a threshold level to avoid accidental triggering by pets or other small motion events. The lighting system may be controlled by the user interface which may set schedules, light intensities, light colors, and other features according to user preference.

The doorbell system uses the plurality of wireless connection or the plurality of powerline connections to communicate with a doorbell which is external to the system, and transmits an auditory notification via the plurality of speakers, as well as sending a notification to the plurality of monitoring devices. In advanced embodiments, the microphone and video capabilities of the plurality of monitoring devices may be used to facilitate communication with corresponding devices on the doorbell. The audio system receives audio data via the plurality of wireless connections or the plurality of powerline connections and plays that audio through the plurality of speakers.

The audio system uses the plurality of motion detectors as well as wireless communication with the plurality of mobile monitoring devices to determine the presence of a person in the room, and actuates the plurality of speakers. The user interfaces of the plurality of mobile monitors may be used to change the source of the audio data, and to control the volume and other sonic features of the audio system. The audio system will also have the capability to produce white noise, controllable by the user interface of the mobile monitors, with the function of calming infants. The user interfaces of the plurality of mobile monitors may further comprise the ability to control any aspect of any of the safety system, security system, wireless repeater system, lighting system, doorbell system, or audio system. In advanced embodiments, the smoke detector system with expanded capabilities may further comprise a cellular receiver.

Although the invention has been explained in relation to its preferred embodiment, it is to be understood that many other possible modifications and variations can be made without departing from the spirit and scope of the invention.

What is claimed is:

1. A smoke detector system comprising:

a first device including:

a housing;

a smoke detector mounted to the housing;

a speaker mounted to the housing;

a motion detector mounted to the housing;

a camera mounted to the housing;

a light mounted to the housing;

a communications device mounted to the housing in signal communication with the smoke detector, the speaker, the motion detector and the camera; and a power source mounted to the housing and supplying electrical power to the smoke detector, the speaker, the motion detector, the camera and the communications device;

wherein the first device is configured to implement a safety system, a security system, a lighting system, and an audio system; and wherein the motion detector is utilized by the security system, the lighting system and the audio system.

2. The smoke detector system of claim 1, wherein the communications device of the first device includes a wireless communications device.

3. The smoke detector system of claim 2, wherein the first device is further configured to implement a wireless repeater system.

4. The smoke detector system of claim 1, further comprising a doorbell in communication with the first device, the first device being further configured to implement a doorbell system.

5. The smoke detector system of claim 1, further comprising a second device substantially identical to the first device and in communication therewith, the safety system, security system, lighting system, and audio system being implemented across both the first and second devices.

* * * * *